United States Patent [19]

Isozaki

[11] Patent Number: 4,805,508

[45] Date of Patent: Feb. 21, 1989

[54] SOUND SYNTHESIZING CIRCUIT

[75] Inventor: Tomoaki Isozaki, Tokyo, Japan

[73] Assignee: NEC Corporation, Tokyo, Japan

[21] Appl. No.: 77,546

[22] Filed: Jul. 24, 1987

Related U.S. Application Data

[63] Continuation of Ser. No. 671,353, Nov. 14, 1984, abandoned.

[30] Foreign Application Priority Data

Nov. 14, 1983 [JP] Japan ..... 58-213637

[51] Int. Cl.[4] ..... G10H 1/00

[52] U.S. Cl. ..... 84/1.01; 84/DIG. 11

[58] Field of Search ..... 381/124; 84/1.01, 1.03, 84/DIG. 11

[56] References Cited

U.S. PATENT DOCUMENTS

| | | | |
|---|---|---|---|
| 4,011,516 | 3/1977 | Heimbigner et al. | 328/14 |
| 4,183,275 | 1/1980 | Mimi et al. | 84/1.01 |
| 4,223,582 | 9/1980 | Kato et al. | 84/1.01 |
| 4,442,748 | 4/1984 | Kaneko et al. | 84/1.01 |

OTHER PUBLICATIONS

Chamberlin, Musical Applications of Microprocessors, 1980, pp. 547–553.

*Primary Examiner*—Forester W. Isen

*Attorney, Agent, or Firm*—Sughrue, Mion, Zinn, Macpeak, and Seas

[57] ABSTRACT

A sound synthesizing circuit has means for synthesizing sound digital data in a pitch period of a sound to be synthesized and means for producing a sound analog signal according to the synthesized sound digital data. The synthesized sound digital data are sequentially transferred to the producing means according to a sequential sampling pulse. The sequential sampling pulse has a predetermined interval and a corrected interval different from the predetermined interval in one pitch period of a sound to be synthesized. Thus, a sound of good quality with an arbitrary interval can be synthesized in a wide scale by a simple hardware integrated circuit in a small semiconductor chip.

7 Claims, 3 Drawing Sheets

FIG 5
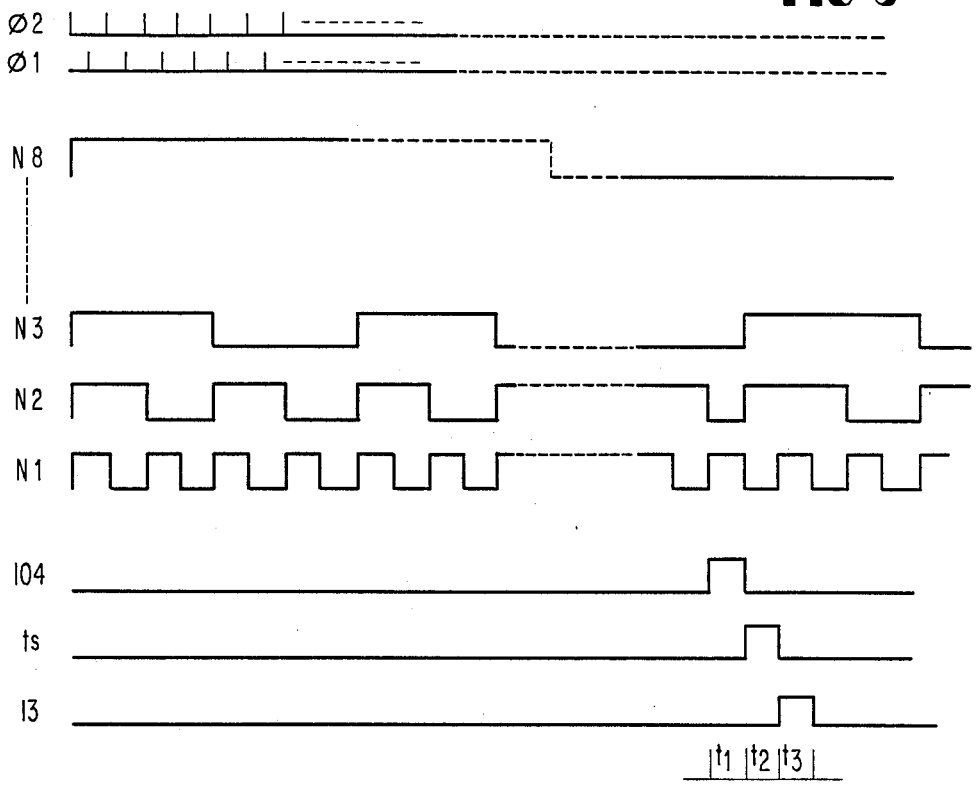
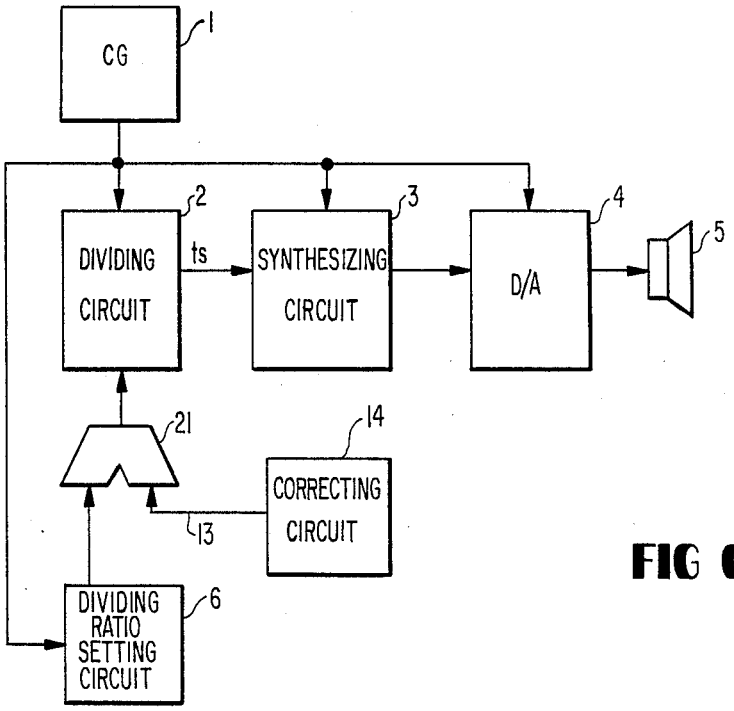
FIG 6

SOUND SYNTHESIZING CIRCUIT

This is a continuation, of application Ser. No. 671,353, filed Nov. 14, 1984 now abandoned.

BACKGROUND OF THE INVENTION

The present invention relates to a sound synthesizing circuit, and particularly to a circuit for synthesizing a musical sound, for example the sound of a piano, a violin, a flute, a whistle, or the like.

In general, conventional musical sound synthesizers are very expensive because of the need for a large number of sound oscillators. However, by employing a semiconductor techniques, a low cost digital synthesizer has been provided in recent years. This prior art digital synthesizer uses a sound waveform synthesizing method which is used in a conventional speech synthesizer. In this synthesizer a waveform of a musical sound to be synthesized is sampled a plurality of times along a time axis, and the amplitude level at each sampling point is digitized according to a predetermined bit number. Thus, waveform data is stored in a memory and is read out of the memory when the musical sound is to be synthesized. In a musical sound waveform, the same waveform is repeated for all pitch periods. Therefore, a representative waveform in only one pitch period usually is used repeatedly to synthesize a desired musical sound. Thus, since memory capacity can be reduced, an integrated circuit on a semiconductor chip is realizable.

The waveform data stored in the memory are sequentially read out of the memory and are synthesized in a synthesizing circuit. The synthesized digital data is sequentially sent to a digital-to-analog converter and is converted to an analog signal in response to a sampling pulse. Thereafter, the analog signal is provided to a speaker.

However, the digital synthesizer of the prior art synthesizes a musical sound according to a sampling pulse which is generated at a predetermined fixed interval. That is, the digital to analog conversion is operated at the fixed same interval as the sampling pulse which is generated at an equal time interval. The sampling pulse is produced by dividing a clock signal generated by a clock generator.

On the other hand, the pitch period must be changed in order to synthesize a different tone from the fundamental tone stored in the memory. In other words, a frequency of the representative waveform has to be changed. The change of the pitch period can be performed by changing the interval of the sampling pulse. As described above, the sampling pulse is produced by a frequency divider which divides the clock signal by a dividing ratio corresponding to a tone to be synthesized.

However, in the case where a waveform in one pitch is divided into 32 sampling points, the following equations are to be satisfied:

$$Ts = N \times T_1 \quad (1)$$

$$Tp = 32 \times Ts = 32 \times N \times T_1 \quad (2)$$

Ts: a period of a sampling pulse

N: a dividing ratio $T_1$: a period of a clock signal

Tp: a pitch period of the waveform to be synthesized

As clear in the above equations (1) and (2), the pitch period Tp of the music sound waveform to be synthesized is changed by only the unit of $32 \times T_1$, if the dividing ratio N is changed by 1. Consequently, the number of tones which can be synthesized by the prior art synthesizer employing a waveform synthesis method has been limited to a small number. Further, when a desired tone frequency (pitch frequency) does not correspond to the integer magnifications of $32 \times T_1$, a frequency lag will be occurred. This lag is a maximum $16 \times T_1$ in one pitch period and is very offensive to the ear.

In order to reduce the frequency lag, the number of divisions of a waveform may be decreased. However, the decrease of the division number introduces inaccuracies into a musical sound with a complex waveform, such as a piano, a trumpet, etc. For these sounds a division number higher than a predetermined number is required.

Therefore, the prior art sound synthesizer has used a high clock frequency. However, an operating speed of an integrated circuit on a semiconductor chip must be increased according to the high clock frequency utilized. As a result, circuit design and also fabrication become very complex, and chip size becomes large. Moreover, in a semiconductor circuit having a complementary type transistor pair (CMOS) power consumption is in proportion to the square of the operating frequency (clock frequency), so that increasing clock frequency is unsuitable for the musical sound synthesizer including an integrated circuit.

SUMMARY OF THE INVENTION

It is an object of the present invention to provide a musical sound synthesizing circuit which can synthesize a musical sound wherein frequency lag is reduced.

Another object of the present invention is to provide a sound synthesizing circuit which can be integrated on a small semiconductor chip.

A further object of the present invention is to provide a sound synthesizer which can synthesize a complex sound without increasing a clock frequency rate.

Still another object of the present invention is to provide a sound synthesizing circuit employing a waveform synthesis method by which a musical sound of good quality can be synthesized.

A musical sound synthesizing circuit according to the present invention comprises a synthesizing circuit having a memory wherein sampling data of a waveform in a fundamental pitch period are stored and a synthesizing means synthesizing a musical sound waveform according to the sampling data stored in the memory, a clock generator generating a clock signal to control an operation of the synthesizing circuit, a sampling pulse generating circuit having a frequency divider generating a sampling pulse according to the clock signal, a digital to analog converter receiving the musical sound waveform data from the synthesizing means and producing a musical sound signal according to the sampling pulse, and a correcting circuit correcting a period of at least one selected sampling pulse among a plurality of sampling pulses generated during a predetermined pitch period corresponding to a pitch frequency of a musical sound to be synthesized.

According to the present invention, the musical sound synthesizing circuit has the correcting circuit which corrects a frequency of at least one sampling pulse at a selected sampling point. Namely, this correcting circuit is provided to change an interval between a selected sampling pulse and the next sampling pulse following the selected sampling pulse from that of the remaining sampling pulses in a desired pitch period of a musical sound to be synthesized. As a result, according to the present invention, at least two sampling pulses which have a different frequency from each other are involved in a pitch period of a musical sound to be synthesized. Therefore, in comparison with the prior art synthesizing circuit wherein a sampling pulse in a pitch period is fixed at the same frequency, the synthesizing circuit of the present invention has advantages as follows:

(1) Frequency lag between a musical sound to be desired and a synthesized musical sound can be remarkably reduced because of correcting a pitch period of a musical sound to be synthesized.

(2) A musical sound of good quality can be synthesized without increasing a clock frequency rate.

(3) A musical sound synthesizing circuit can be integrated in a small semiconductor chip.

(4) A musical sound with a wide scale and many intervals can be synthesized by a simple hardware circuit.

BRIEF DESCRIPTION OF THE DRAWING

FIG. 5 shows a timing chart indicating an operation of the sampling pulse generating section in FIG. 4; and FIG. 6 shows a block diagram of another embodiment according to the present invention.

DESCRIPTION OF THE PRIOR ART

Figure 1:
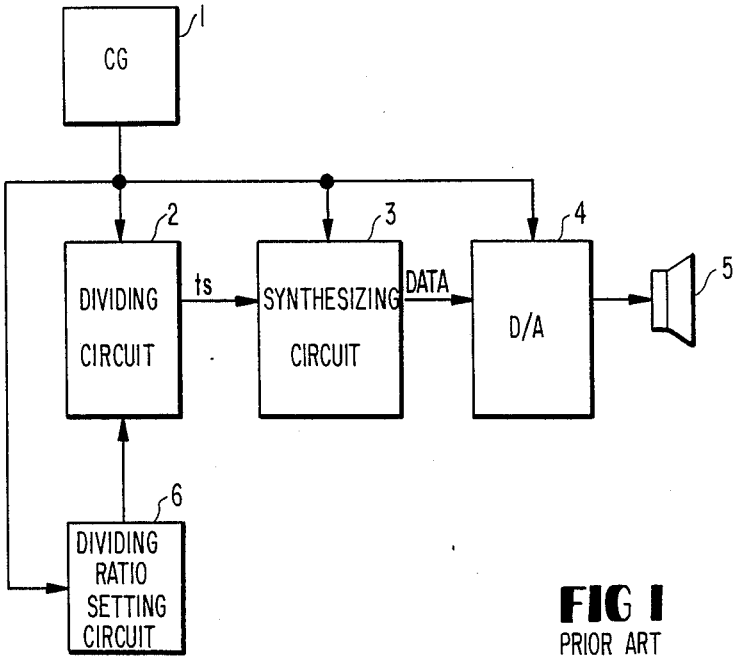
FIG 1 PRIOR ART
FIG. 1 shows a block diagram of the prior art synthesizing circuit employing a waveform synthesis method.

A block diagram of FIG. 1 shows the prior art synthesizing circuit employing a waveform synthesis method, in which a clock generator 1, a frequency dividing circuit 2, a waveform synthesizing circuit 3, a digital to analog converter 4 and a dividing ratio setting circuit 6 are integrated in a single semiconductor chip. The clock generator 1 generates a clock signal and applies the clock signal to the other circuits 2, 3, 4 and 6 to control operations of these circuits. The frequency dividing circuit 2 divides the clock signal into a sampling pulse ts with a constant frequency (the same interval) according to the dividing ratio applied from the setting circuit 6. The setting circuit 6 prepares a dividing ratio corresponding to a pitch frequency of a musical sound to be synthesized and applies it to the dividing circuit 2 in every pitch period. The waveform synthesizing circuit 3 sequentially reads digitized waveform data out of the memory according to the address information designating a group of a musical sound to be synthesized and transfers the read out waveform data (e.g. 8-bit, 10-bit, or the like per one address) to the digital to analog converter 4 in response to the sampling pulse ts. The sampling pulse ts is used to synchronize transferring timing of the waveform data with the operation timing of the D/A converter 4. Namely, the waveform data indicating an amplitude level of the musical sound to be synthesized at each sampling point is transferred to the D/A converter 4 in synchronism with a period of the sampling pulse produced by the dividing circuit 2 according to the pitch period of the musical sound to be synthesized. Thus, a musical sound signal with the required pitch frequency is applied to a speaker 5 through the D/A converter 4. The synthesizing circuit 3 may modify the read out waveform data to change an amplitude level of the musical sound if required.

Now, when a musical sound with 440 Hz pitch frequency (2.27 ms pitch period) is required, a pitch frequency of a musical sound capable of synthesizing in the synthesizing circuit of FIG. 1 is 426 Hz according to the abovementioned equations (1) and (2).

Because, $$Tp = 32 \times 11 \times 6.666\ \mu s = 2.35\ ms$$
$$= 426\ Hz$$

In this case, it is assumed that a waveform is divided into 32 sampling points and that 150 kHz is used as the clock frequency.

Therefore, a pitch period error of 3.2% occurs between the required musical sound and the synthesized musical sound. This is because the sampling pulse rate depends on only the dividing ratio N. It may be easily understood that the error can be corrected by increasing in the clock frequency rate or decreasing in the number of sampling points. However, these operations have shortcomings as described before.

DESCRIPTION OF THE PREFERRED EMBODIMENT

Figure 2:
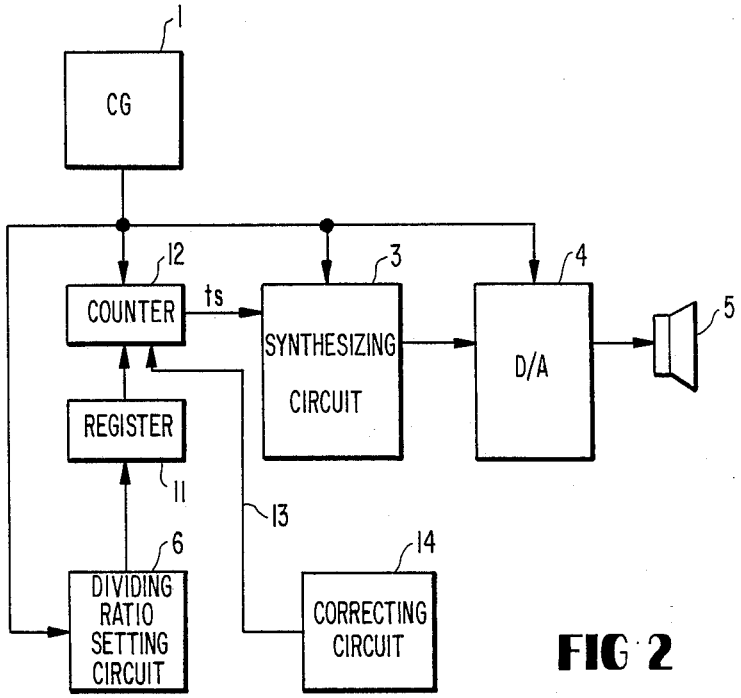
FIG. 2 shows a block diagram of an embodiment of the present invention indicating a musical sound synthesizing circuit employing a waveform synthesis method.

FIG. 2 shows a block diagram of an embodiment according to the present invention, in which a different section from FIG. 1 is a frequency dividing section and a correcting circuit 14 is newly added. The frequency dividing section comprises a register 11 and a counter 12. The other circuits, that is, the clock generator 1, the waveform synthesizing circuit 3, the digital to analog converter 4 and a dividing ratio setting circuit 6 and their operations are the same as FIG. 1. Therefore, explanation of these circuits and operations will be omitted.

In FIG. 2, the register 11 receives a dividing ratio information indicating a pitch period of a musical sound to be synthesized from the setting circuit 6 and supplies it to the counter 12 at every pitch period. A down-counter is used as the counter 12, but an up-counter may be used. At the beginning of a synthesis operation, a dividing ratio information N prepared in the setting circuit 6 is preset into the down-counter 12 from the register 11 and is sequentially decreased by 1 in response to the clock signal. Namely, when n clock pulses have been applied to the downcounter 12, the content of the down-counter 12 becomes zero, thus the first sampling pulse $ts_1$ is generated. The downcounter 12 receives the dividing ratio information N again in response to the first sampling pulse and down counts the information N. Upon termination of this down counting operation, the second sampling pulse $ts_2$ is generated. By repeating these operations, the third sampling pulse, the fourth sampling pulse, . . . , the N-th sampling pulse, . . . are sequentially generated and applied to the synthesizing circuit 3 to control an output timing of the synthesizing circuit 3.

In this case, intervals between each sampling pulses are the same as each other, so that a musical sound with a pitch period (= the number of sampling points x the dividing ratio N× the period of the clock signal) can be synthesized.

On the other hand, when the correcting circuit 14 is activated, this circuit 14 sends a control signal 13 to the down-counter 12 at a predetermined timing. The down-counter 12 generates a sampling signal having a period determined by dividing the clock frequency into N+1 whenever the control signal 13 is applied to the counter 12. This operation can be performed by stopping the counting operation during one-downcount according to the control signal 13, so that the downcounter generates the sampling pulse divided into N+1.

According to the embodiment, a pitch period of a musical sound can be changed by the span of the period of the clock signal. If the control signal 13 is generated i times ($1<i<K-1$ when the number of sampling points is K), the pitch period Tp of a musical sound to be synthesized is as follows:

$$\begin{aligned} Tp &= i \times (N+1) \times T_1 + (K-i) \times N \times T_1 \\ &= K \times N \times T_1 + i \times T_1 \; (i = 1, 2, 3, \ldots, k-1) \end{aligned}$$

In the synthesizing circuit according to this embodiment, the error of a pitch period can be reduced to 1/K.

Figure 3:
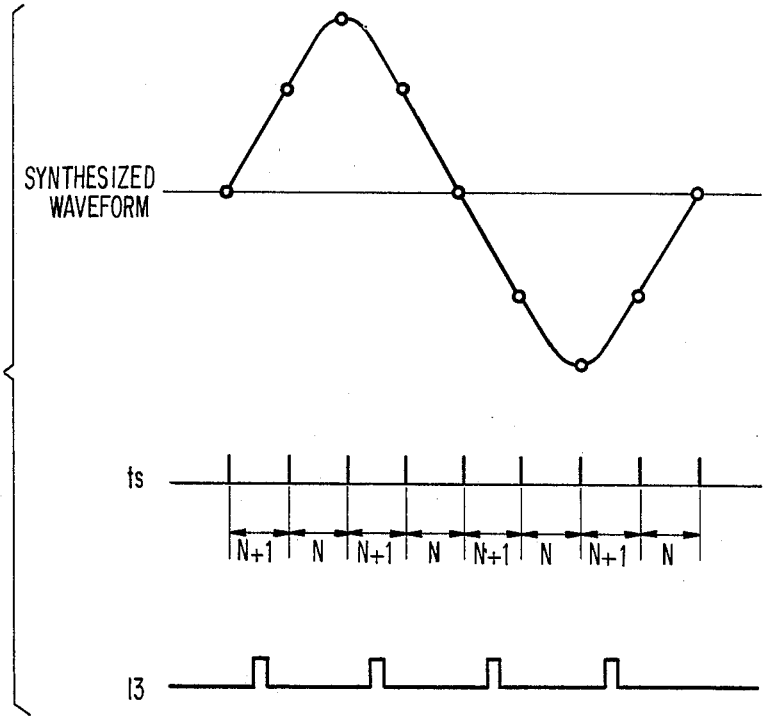
FIG. 3 shows a timing chart indicating an operation of the synthesizing circuit shown in FIG. 2.

In FIG. 3, an example of a sine waveform synthesis is shown. In this example, it is assumed that k is 8, i is 4 and that the control signal 13 is generated at a period of an odd number, so that the pitch period Tp of the sine wave, that is $Tp=4\times N\times T1+4\times(N+1)\times T1=8\times N\times T1+4\times T1-=8\times(N+\frac{1}{2})\times T1$, can be obtained. Namely, this pitch period is in the middle of the pitch periods obtained when the dividing ratio N and the dividing ratio N+1 are set in the down-counter respectively, in the prior art of FIG. 1.

Figure 4:
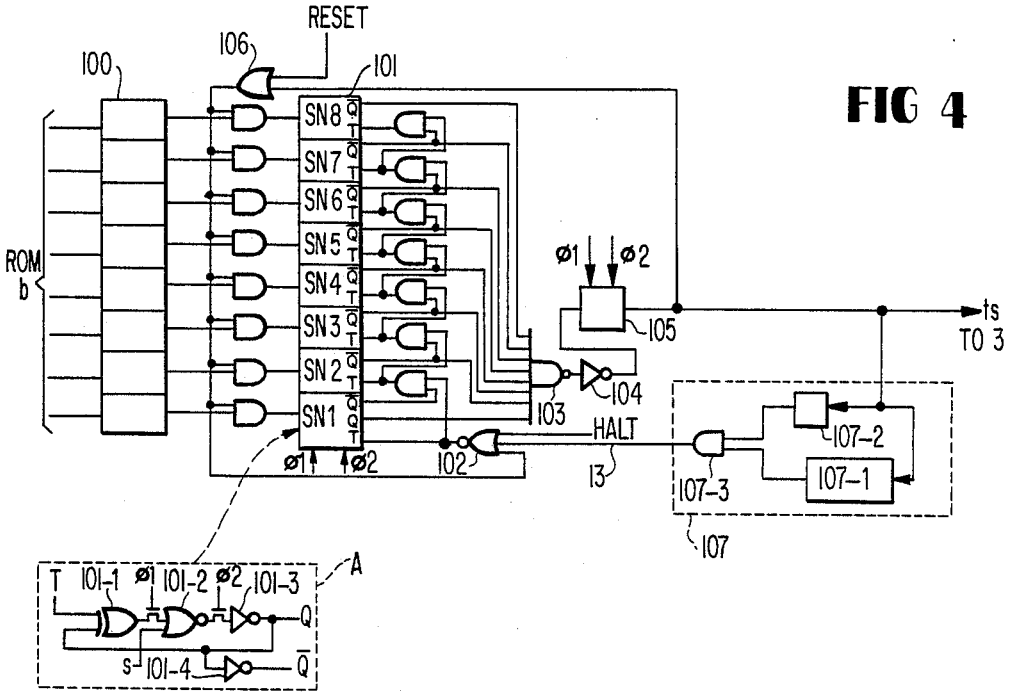
FIG. 4 shows a block diagram of a principle part (i.e. a sampling pulse generating section) of FIG. 2.

A preferred block diagram of the frequency dividing section and the correcting section according to the embodiment of FIG. 2 is shown in FIG. 4 in which an 8-bit register 100 and an 8-bit down-counter 101 are used as the register 11 and the down-counter 12, respectively. The 8-bit register 100 receives a dividing ratio information consisting of 8 bits. Each stage of the 8-bit down counter 101 has an exclusive OR gate 101-1 and a flip-flop circuit (101-2, 101-3 and 101-4) shown in block A. An input end T receives an output of AND gate corresponding to the respective stage. The AND gate receives two signals, one is an output $\overline{Q}$ of the preceding stage, the other is an output of the preceding AND gate. However, the first stage receives an output of an NOR gate 102 at an input end T. An output Q of th first stage and outputs $\overline{Q}$ of the second through eighth stages are applied to an NAND gate 103 in common. An output of the NAND gate 103 is sent to a one-bit delay circuit 105 via an inverter 104. An output of the delay circuit 105 is used as the sampling pulse ts and is transferred to a group of AND gates inserted betweeen the 8-bit register 100 and the 8-bit down counter 101 through an OR gate 106 which receives a RESET signal at the other input end. The NOR gate 102 receives three input signals, one is a HALT signal, another is a control signal 13, and the other is the sampling pulse ts. The control signal 13 is generated by a correcting circuit 107 having a programmable counter 107-1, a one-bit delay circuit 107-2 and an AND gate 107-3. A data designating an output timing of the control signal 13 is set in the programmable counter 107-1 and is counted down in response to the sampling pulse ts.

An operation of FIG. 4 will be described referring to FIG. 5. Two phase clock signals $\phi$1 and $\phi$2 are generated by the clock generator. A dividing ratio information N is preset into the down-counter 101 and is counted down in response to clock signals $\phi$1 and $\phi$2 as shown in FIG. 5. When the content of the down-counter 101 becomes 1, that is, 00000001, the output of the NAND gate becomes a low level. Therefore, a high level signal is represented at an output of the invertor 104 at a timing t1. The sampling pulse ts is generated after one-bit delay time at a timing t2. Now, if a counting operation of the programmable counter 107-1 is terminated at the timing t2, a high level signal is applied to the AND gate 107-3. This high level signal is sent to the NOR gate 102 at a timing t3 after one bit delay operation and is used as a control signal 13. Thus, an output of the NOR gate 102 becomes a low level, so that the AND gates coupled to input ends T generate a low level signal. As the result, the counting operation of the down-counter 101 is stopped during one bit time at the timing t3. Therefore, the counter 101 counts N+1 at this condition.

Besides stopping the counting operation, a dividing ratio information to be set in the register 11 or 100 may be changed as shown in FIG. 6. In this case, an arithmetic circuit 21 (e.g. an adder) is required. A frequency dividing circuit 2 can be used the same as that used in the prior art. To the dividing circuit 2, a dividing ratio N is set when the control signal 13 is not generated, while a dividing ratio N+1 is set when the control signal 13 is generated from the correcting circuit 14 because of adding the dividing ratio N to 1 which is transferred from the correcting circuit 14.

What is claimed is:

1. A sound synthesizing circuit comprising a clock generator generating a clock signal, a synthesizing circuit having means for storing information relating to sound to be synthesized and means for synthesizing sound data into a desired waveform according to said information in said storing means, said information having digital data indicating an amplitude level of a sound to be synthesized at each of a plurality of sampling points in a predetermined pitch period, said synthesizing means sequentially reading said digital data at each said plurality of sampling points out of said storing means and producing a plurality of sound data according to the read out digital data to create said waveform, a dividing ratio generating means for generating a plurality of dividing ratio data, a dividing circuit comprising a counter coupled to said clock generator and said dividing ratio generating means for dividing said clock signal and generating a sequence of sampling pulses according to a dividing ratio data supplied thereto from said dividing ratio generating means, and a digital to analog converting circuit sequentially converting said plurality of sound data into a sound analog signal, said plurality of sound data being transferred to said digital to analog converting circuit in response to said sequential sampling pulses, said dividing ratio generating means including register means for storing said dividing ratio data and said counter being responsive to said register means and said clock generator for counting to a predetermined count established in response to said dividing ratio data to generate said sampling pulses, and converting circuit means comprising a programmable counter and a gate means responsive to said sampling pulses for generating a control signal for altering at least one interval of said sequential sampling pulses and means for stopping a dividing operation of said dividing circuit during a predetermined period in response to said control signal.

2. A synthesizing circuit for sound having at least one pitch period comprising means for storing a predetermined number of sound waveform data in one pitch period to be synthesized, means for sequentially reading said sound waveform data according to a predetermined order out of said storing means in response to a plurality of sampling pulses successively applied to said storing means in one pitch period, means for producing a sound signal according to the sequentially read out sound waveform data, and means for changing an interval of said sampling pulses within one pitch period, whereby said sampling frequency may be changed at each sampling point without substantially changing the waveform, said changing means comprising a frequency dividing means for storing a dividing ratio data and counting to a predetermined count established in response to said dividing ratio data to produce said sampling pulses and correcting circuit means comprising gate means and a programmable counter responsive to said sampling pulses for generating a control signal for altering the frequency of at least one of said sampling pulses during a pitch period by changing the count of said frequency dividing means.

3. A sound synthesizing circuit as claimed in claim 2, in which said sound waveform data stored in said storing means is repeatedly used at every pitch period of a sound to be synthesized.

4. In a sound synthesizing circuit having a frequency dividing circuit which divides a clock signal into a plurality of sampling pulses according to a predetermined dividing ratio signal for sampling data stored in a memory, the improvement comprising:

a frequency divider circuit comprising a register means for storing said dividing ratio signal and counter means responsive to said stored signal and said clock signal for generating a plurality of sampling pulses during one pitch period; and a changing circuit for changing a value of said predetermined dividing ratio signal in at least one sampling point during one pitch period corresponding to a pitch frequency of a sound to be synthesized, said changing circuit comprising gate means and a programmable counter responsive to said sampling pulses for generating a control signal for altering at least one interval of said sequential sampling pulse and means for altering a dividing operation of said divider circuit during a predetermined period in response to said control signal.

5. A synthesizing circuit for sound having at least one pitch period comprising:

means for generating a clock signal;

means for generating sampling pulses according to said clock signal;

means for sampling data of a waveform using said sampling pulses;

means for storing said data;

means for synthesizing a sound waveform from said stored data;

said means for generating sampling pulses according to said clock signal said means for controlling comprising a first counter for receiving the clock pulses and a register for receiving a dividing ratio signal, said register providing dividing ratio information to said counter at every pitch period of said sound to be synthesized, said first counter generating said sampling pulses; and means for changing a period of at least one sampling pulse among a plurality of said sampling pulses generated during a predetermined pitch period corresponding to a pitch frequency of a sound to be synthesized, said means for changing comprising a second counter and being connected to receive said sampling pulses and to transmit a count delay signal to said means for generating.

6. A synthesizing circuit as claimed in claim 5 wherein said first counter is a down-counter.

7. A synthesizing circuit as claimed in claim 5 wherein said first counter is an up-counter.

* * * * *